US005433367A

United States Patent [19]

Liu

[11] Patent Number: 5,433,367

[45] Date of Patent: Jul. 18, 1995

[54] MAGAZINE ASSEMBLY FOR A FASTENER DRIVING TOOL

[76] Inventor: Park Liu, No. 15, Nan-Chien Rd., Ting-Tai Tsun, Wu-Feng Hsiang, Taichung Hsien, Taiwan

[21] Appl. No.: 348,170

[22] Filed: Nov. 28, 1994

[51] Int. Cl.[6] ..... B25C 5/16

[52] U.S. Cl. ..... 227/120

[58] Field of Search ..... 227/120, 109, 119, 123

[56] References Cited

U.S. PATENT DOCUMENTS

| | | | |
|---|---|---|---|
| 2,073,958 | 3/1937 | Crosby | 227/120 |
| 3,615,049 | 10/1971 | Obergfell et al. | 227/120 |
| 3,905,535 | 9/1975 | Novak et al. | 227/120 |
| 4,519,533 | 5/1985 | Jirovetz | 227/120 |
| 4,903,880 | 2/1990 | Austin et al. | 227/120 |
| 5,335,800 | 8/1994 | Liu | 227/120 |

*Primary Examiner*—Scott A. Smith

*Attorney, Agent, or Firm*—Beveridge, DeGrandi, Weilacher & Young

[57] ABSTRACT

An improved magazine assembly for a fastener driving tool including a parallel guide groove provided in one side of a guide plate, and a recess is provided in one rear end of the guide groove, a bent portion of the pusher for fastening guide plates being inserted into the guide groove and two sets of screws are for fastening the guide plate. The stop has accommodated therein the coil spring which has an end thereof fastened with the side of corresponding nose portion. By this arrangement, when loading or removing of fasteners, the stop is pulled to cause the slot to displace rearward to the recess of the rear end of the guide plate. The pusher has one side thereof retained and positioned in the slot. In this manner, the fasteners may be smoothly loaded. The user may further control the stop to cause the pusher to detach from the slot, since the stop and the pusher may automatically move along a specified direction to push to a suitable place.

2 Claims, 3 Drawing Sheets

MAGAZINE ASSEMBLY FOR A FASTENER DRIVING TOOL

BACKGROUND OF THE INVENTION (a) Field of the Invention

The present invention relates generally to an improved magazine assembly for a fastener driving tool, and more particularly to an improved magazine assembly with few structural elements and which facilitates assembly and loading and unloading of fasteners.

(b) Description of the Prior Art

As is known in the art, the type of fasteners used in a fastener driving tool varies according to the nature of a workpiece. For instance, T-shaped fasteners and U-shaped fasteners are used in conjunction with different specialized magazines. In the present invention, the magazine assembly is adapted for T-shaped fasteners.

The most widely used magazine assembly for T-shaped fasteners is shown in FIG. 1. The conventional magazine assembly shown mainly comprises a magazine 10, a stop means 11, a pusher means 12, an arrester means 13, a coil spring 14 and a nose portion 15. The magazine 10 includes a guide plate 101 and an abutment plate 102. The stop means 11 is restrained by the arrester means 13 to cover the outer periphery of the magazine 10. The coil spring 14 is insertably provided in the stop means 11. By utilizing the resilience of the coil spring 14, the pusher means 12 is pushed forward to enable fasteners contained in a drive track element 103 provided on the abutment plate 102 to move intermittently toward the nose portion 15 to be driven into a workpiece. Although this structural design has the advantages of using less time and energy, there are some latent problems waiting to be solved.

In the first place, because the conventional magazine assembly consists of quite a number of structural elements, assembly is not easy. In particular, the coupling of the stop means 11 and the pusher means 12 must rely on a fixing pin 16, a torsion spring 17 and a C-ring 18. In addition, the stop means 11 has to depend on the attester means 13 to ensure that its movement's orientation is accurate and that it may not easily drop. The manufacturing cost of this kind of fastener driving tool is therefore high.

In the second place, when a user pulls the pusher means 12 so that the stop means 11 is caused to displace downward to the end of the abutment plate 102 for loading fasteners (not shown), because the pusher means 12 is not provided with any gripping means, the user must use one hand to hold the pusher means 12 and use the other hand to load fasteners. The fastener driving tool is quite heavy, and the resilience of the coil spring is substantially strong, it will be greatly inconvenient to the user who has to support such a great load with a single hand.

SUMMARY OF THE INVENTION

The primary object of the present invention is to provide an improved magazine assembly for a fastener driving tool which is less costly to manufacture and easy to assemble.

Another object of the present invention is to provide a magazine assembly for a fastener driving tool which facilitates loading and unloading of fasteners.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
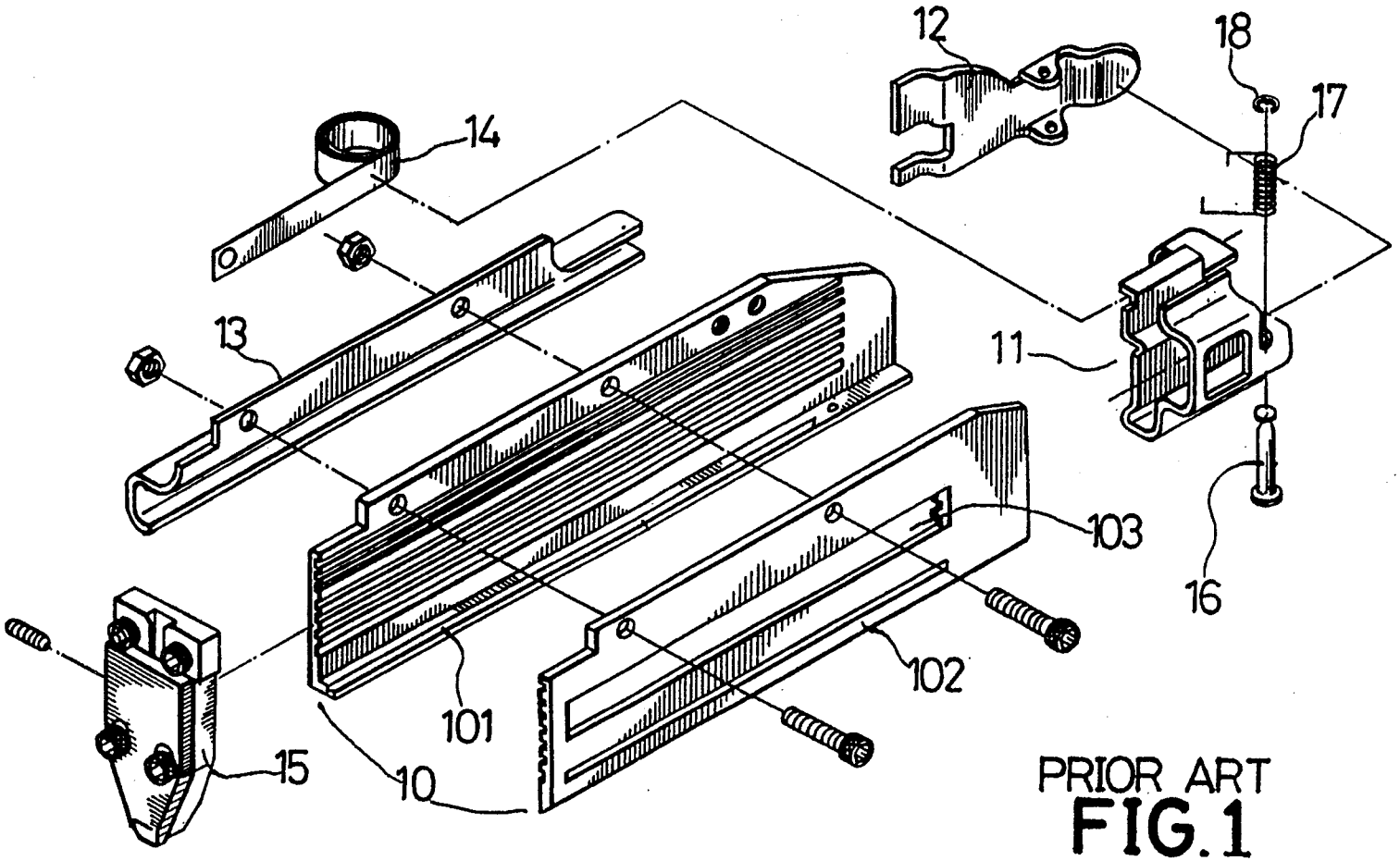
PRIOR ART FIG. 1
FIG. 1 is an exploded perspective view of the conventional magazine assembly for fastener driving tools.
Figure 2:
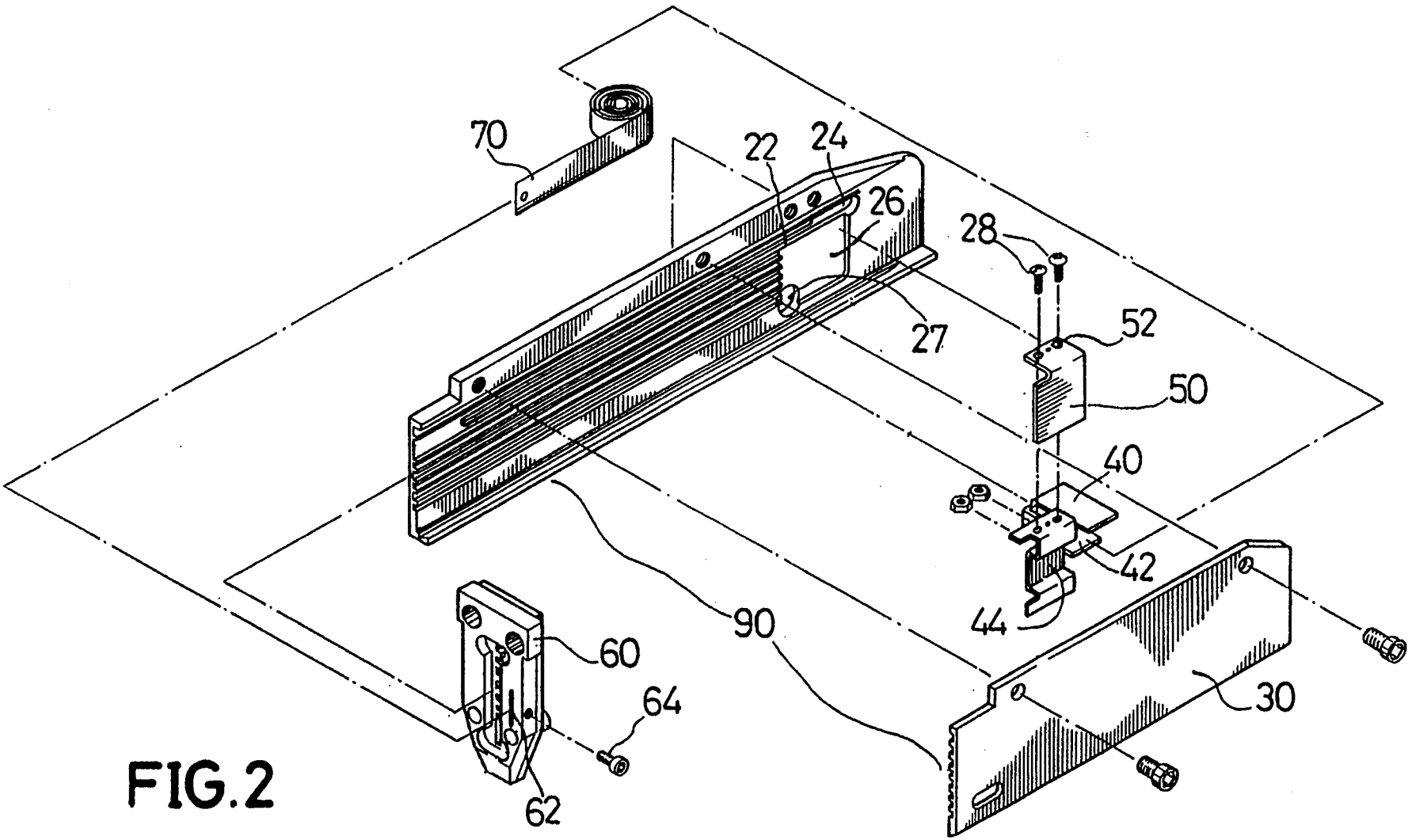
FIG. 2 is an exploded perspective view of the present invention.
Figure 3:
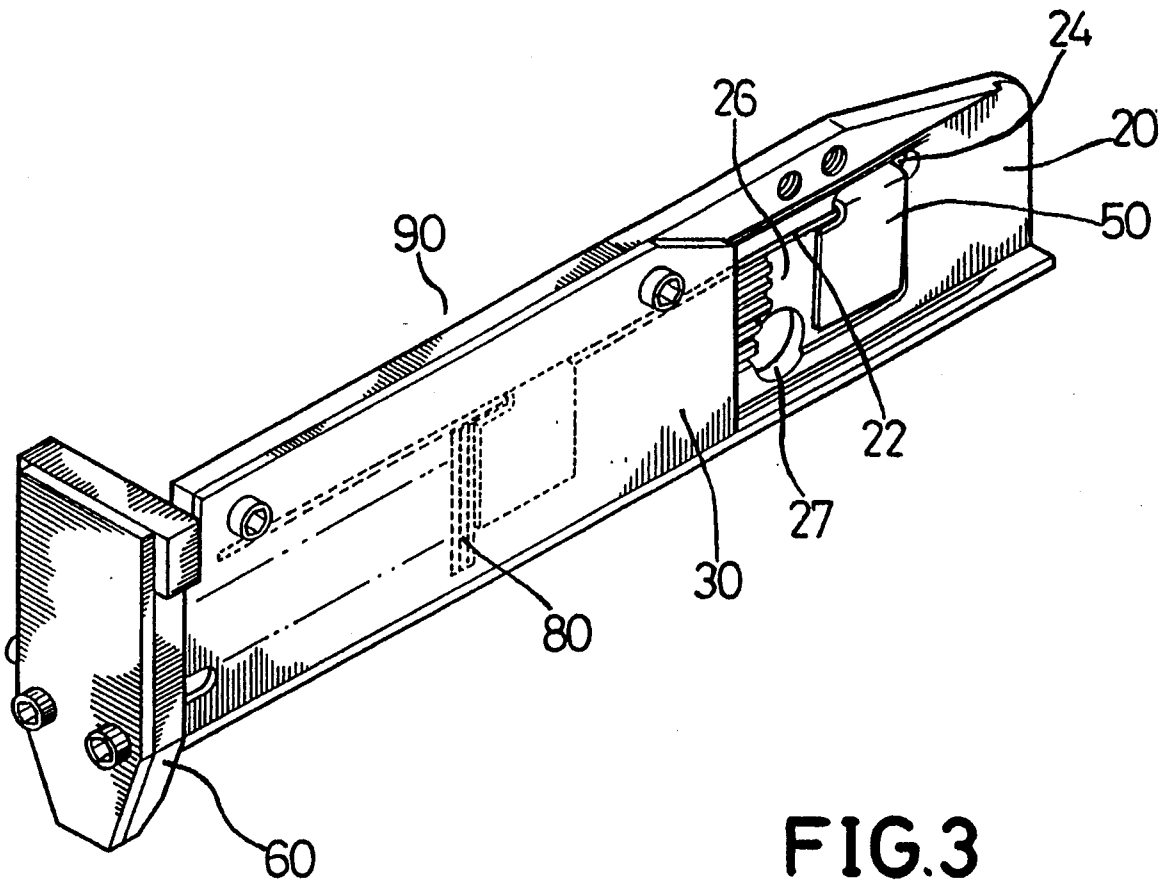
FIG. 3 is a perspective view of the present invention after it is assembled.

With reference to FIGS. 2 and 3, the improved magazine assembly of the present invention comprises a guide plate 20, an abutment plate 30, a stop means 40, a pusher means 50, a nose portion 60 and a coil spring 70. The present invention is characterized in that one side of an end of the guide plate 20 is provided with a parallel guide groove 22 the rear end thereof having a slot 24 which is provided with a recess 26 in one lateral side thereof. The pusher plate 50 has a bent end portion 52 inserted into the guide groove 22, and two sets of screws 28 are used to fasten the bent portion 52 and the stop means 40. The stop means 40 has provided therein the coil spring 70 which has an end thereof inserted into a hole 62 in a corresponding side of the nose portion 60 and fastened and positioned in place by means of a screw 64.

By means of the above-described structure, when the user wants to load fasteners or remove fasteners 80, the user may pull the stop means 40 to enable the pusher means 50 to move rearward to the recess 26 in the rear end of the guide plate 20 and to cause one side of the pusher means 50 to be stuck in the slot 24 to be locked and positioned. In this manner, the fasteners 80 may be smoothly loaded or unloaded. After finishing loading or unloading fasteners 80, the user may control the stop means 40 to enable the pusher means 50 to disengage from the slot 24, and the stop means 40 and pusher means 50 may then automatically move along the guide groove 22 in the direction restricted thereby to a suitable position due to the function of the coil spring 70.

Because the manner of engagement of the guide plate 20 and the abutment plate 30, as well as the manner of coupling of the nose portion and a magazine 90 and the coil spring 70 belong to conventional technique, their way of engagement will not be described in detail herein.

The stop means 40 has a recess 42 in a rear end thereof for receiving the coil spring 70, and a slide groove 44 is provided at the front end thereof joining the rear side of the guide plate 20 for receiving the spring coil 70 when the stop means 40 is moved.

Additionally, when the user pulls the pusher means 50 rearward to remove the fasteners 80, the rear end of the fasteners may contact the corresponding end surface of the pusher means 50 to form a butting joint, impeding the loading action. Therefore, in the present invention, to facilitate easy loading or unloading of fasteners 80, a through hole 27 is provided in a slightly upper position of one side of the recess 26 of the guide plate 20 for the user to insert a finger from the bottom end of the guide plate 20 through the through hole 27 to push away the fasteners 80 which are in contact with the pusher means 50.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved magazine assembly for a fastener driving tool, said magazine assembly comprising a guide plate, an abutment plate, a stop means, a pusher means, a nose portion and a coil spring, wherein a parallel guide groove is provided in one side of an end surface of said guide plate and which has a slot in a rear end thereof, said guide plate having a recess provided in one side thereof, and said pusher means has a pusher plate and a bent end portion, said bent end portion inserted into said guide groove, said bent end portion being fastened with said stop means by two screws, said stop means having accommodated therein a coil spring which has an end thereof inserted in a corresponding lateral side of said nose portion, wherein said stop means is movable rearwardly to bring said pusher plate into said recess in the side of said guide plate by causing said bent end portion to be locked in said slot, said bent end portion thereafter disengageable from said slot, wherein said stop means and said pusher means automatically move along a forward direction due to the bias of said coil spring.

2. An improved magazine assembly as claimed in claim 1, wherein a through hole is provided in a lower portion of said recess in said guide plate, enabling a user to pass one finger from a lower portion of said guide plate into said through hole to facilitate unloading of fasteners.

* * * * *